US009868196B2

(12) United States Patent
Chien

(10) Patent No.: US 9,868,196 B2
(45) Date of Patent: Jan. 16, 2018

(54) HANDHELD POWER TOOL AND IMPACT BLOCK RETURN DEVICE THEREOF

(71) Applicant: BASSO INDUSTRY CORP., Taichung (TW)

(72) Inventor: Chia-Yu Chien, Taichung (TW)

(73) Assignee: BASSO INDUSTRY CORP., Taichung (TW)

( * ) Notice: Subject to any disclaimer, the term of this patent is extended or adjusted under 35 U.S.C. 154(b) by 316 days.

(21) Appl. No.: 14/724,053

(22) Filed: May 28, 2015

(65) Prior Publication Data

US 2015/0352702 A1 Dec. 10, 2015

(30) Foreign Application Priority Data

Jun. 5, 2014 (TW) ..... 103119579 A

(51) Int. Cl.

| | |
|---|---|
| ***B25C 1/04*** | (2006.01) |
| ***B25C 5/02*** | (2006.01) |
| ***B25C 5/06*** | (2006.01) |
| ***B25C 1/06*** | (2006.01) |

(52) U.S. Cl.

CPC ..... *B25C 1/047* (2013.01); *B25C 1/06* (2013.01)

(58) Field of Classification Search

CPC .. B25C 1/06; B25C 1/001; B25C 1/04; B25C 1/047; B25C 5/1606

USPC ..... 227/107–139

See application file for complete search history.

(56) References Cited

U.S. PATENT DOCUMENTS 3,305,156 A * 2/1967 Khan ..... B25C 5/06 227/109
4,121,745 A * 10/1978 Smith ..... B25C 1/06 173/13
4,129,240 A * 12/1978 Geist ..... B25C 1/06 227/131

(Continued)

FOREIGN PATENT DOCUMENTS

CN 101239458 A 8/2008
CN 201500965 U 6/2010

(Continued)

OTHER PUBLICATIONS

Office Action issued in corresponding Taiwanese Application No. 103119579 dated Jul. 14, 2017 (4 pages).

*Primary Examiner* — Robert Long
(74) *Attorney, Agent, or Firm* — Osha Liang LLP

(57) ABSTRACT

The present invention provides a handheld power tool having an impact block and an impact block return device. The impact block has a plurality of continuous teeth arranged along a lengthwise direction of the impact block. The impact block return device comprises a gearwheel engaged with the teeth of the impact block; a ratchet wheel rotating simultaneously with the gearwheel; and a clamping member operated in a first state and a second state, the clamping member contacting the ratchet wheel in the first state and the clamping member being separated from the ratchet wheel in the second state; wherein the impact block only can do a single-directional movement when the clamping member contacts the ratchet wheel in the first state. The present invention can improve stability of the retraction process of the impact block (e.g., a firing pin).

10 Claims, 12 Drawing Sheets

(56) References Cited

U.S. PATENT DOCUMENTS 4,189,080 A * 2/1980 Smith ..... B25C 1/06 227/131
4,204,622 A * 5/1980 Smith ..... B25C 1/003 173/1
4,215,808 A * 8/1980 Sollberger ..... B25C 1/041 173/204
4,519,535 A * 5/1985 Crutcher ..... B25C 1/06 227/120
4,558,747 A * 12/1985 Cunningham ..... B25C 1/06 173/121
4,724,992 A 2/1988 Ohmori
5,069,379 A * 12/1991 Kerrigan ..... B25C 1/06 227/120
5,098,004 A * 3/1992 Kerrigan ..... B25C 5/15 173/121
5,320,270 A * 6/1994 Crutcher ..... B25C 1/06 173/121
6,997,367 B2 2/2006 Hu
7,204,403 B2 * 4/2007 Kenney ..... B25C 1/06 227/120
7,503,401 B2 * 3/2009 Gross ..... B25C 1/06 173/131
7,556,184 B2 * 7/2009 Brendel ..... B25C 1/06 227/132
7,789,169 B2 * 9/2010 Berry ..... B25C 1/06 173/213
8,511,532 B2 * 8/2013 Chien ..... B25C 1/06 227/120
8,763,874 B2 7/2014 McCardle et al.
2005/0217873 A1 * 10/2005 Gross ..... B25C 1/06 173/1
2005/0218177 A1 * 10/2005 Berry ..... B25C 1/06 227/8
2005/0218178 A1 * 10/2005 Berry ..... B25C 1/06 227/8
2005/0218183 A1 * 10/2005 Berry ..... B25C 1/06 227/131
2007/0102471 A1 * 5/2007 Gross ..... B25C 1/06 227/131
2007/0210133 A1 * 9/2007 Oda ..... B25C 1/06 227/131
2008/0048000 A1 * 2/2008 Simonelli ..... B25C 1/008 227/132
2008/0302852 A1 * 12/2008 Brendel ..... B25C 1/06 227/131
2009/0090759 A1 4/2009 Leimbach et al.
2009/0294504 A1 * 12/2009 Kunz ..... B25C 1/06 227/8
2010/0032468 A1 2/2010 Gross et al.
2012/0097729 A1 * 4/2012 Gross ..... B25C 1/06 227/129
2012/0286017 A1 11/2012 Gross et al.

FOREIGN PATENT DOCUMENTS

CN 201848826 U 6/2011
CN 202180455 U 4/2012
TW 547276 U 8/2003
TW 566293 U 12/2003
TW 1236405 B 7/2005
TW 200534958 A 11/2005
TW 200932442 A 8/2009
TW 1379746 B 12/2012

* cited by examiner

HANDHELD POWER TOOL AND IMPACT BLOCK RETURN DEVICE THEREOF

TECHNICAL FIELD OF THE INVENTION

The present invention relates to a handheld power tool, and more particularly, to an impact block return device of the handheld power tool.

BACKGROUND OF THE INVENTION

During a shooting or launching stage of a nail gun among conventional power tools, a firing pin passes dynamic energy to a nail such that the nail is stuck into a workpiece from the surface of the workpiece. After completed in shooting, the firing pin has to be moved back to a start position and waits for a next shooting. However, in the process of retracting the firing pin as known in conventional nail guns, the firing pin often cannot be moved right back to the start position due to inappropriate internal structural design or suffering from external forces. Such nail guns often cannot achieve expected power and effect on the next shooting and thus the operation of nail shooting is affected.

It has been disclosed a conventional nail driving tool in Taiwan Patent Publication No. 200932442. The nail driving tool includes a lifter member, a latch member, and a driver member. The driver member has a first protrusion and a second protrusion disposed at two opposite sides thereof. The lifter member and the latch member are arranged corresponding to the two sides of the driver member, respectively. The first protrusion is driven by the lifter member such that the driver member is moved from a shooting position to a preparing position. During the lifter member moves the driver member, the second protrusion at the opposite side is captured by the latch member.

As for mechanical element design, the driver member has uneven overall thickness duo to the protrusions fabricated at the two sides thereof, and thus is weak in strength, easy to be damaged, and high in manufacturing cost. As for operational performance, the driver member may suffer from a great deal of deformation during the heating process and this may probably result in size mismatches between various components, thereby leading the operations to be more unstable. As for lifetime, the lifter member is directly driven by an electric motor, and the electric motor may have a short lifetime since the loading in activating the electric motor is large.

SUMMARY OF THE INVENTION

An objective of the present invention is to provide a handheld power tool and an impact block return device capable of increasing stability of a retraction process of an impact block (e.g., a firing pin).

To achieve above objective, the present invention provides a handheld power tool, having a main body, a nail magazine, an impact block, and an impact block return device, the main body having an exit at one end thereof, the exit communicating with the nail magazine and the impact block return device, the main body having a compressed air chamber at the other end thereof, the compressed air chamber accommodating the impact block, the impact block having a plurality of continuous teeth arranged along a lengthwise direction of the impact block, the impact block return device comprising: a gearwheel adjacent to and engaged with the teeth of the impact block; a ratchet wheel connecting to the gearwheel and rotating simultaneously with the gearwheel; and a clamping member disposed at a position corresponding to the ratchet wheel and located away from the teeth of the impact block, the clamping member being operated in a first state and a second state, the clamping member contacting the ratchet wheel in the first state and the clamping member being separated from the ratchet wheel in the second state; wherein the impact block only can do a single-directional movement when the clamping member contacts the ratchet wheel in the first state.

In another aspect, the present invention provides an impact block return device for retracting an impact block having a plurality of continuous teeth arranged along a lengthwise direction of the impact block, the impact block return device comprising: a gearwheel engaged with the teeth of the impact block; a driven cam coupled to the gearwheel and rotating simultaneously with the gearwheel, the driven cam having a plurality of protruding blocks disposed on a wheel face thereof, the protruding blocks being annularly arranged at intervals; an actuating cam driven by an electric motor, for driving the driven cam; and a clamping member disposed at a position corresponding to the driven cam and located away from the teeth of the impact block, the clamping member being operated in a first state and a second state, the clamping member being located between any two protruding blocks of the driven cam in the first state and the clamping member being moved away from a moving track of the protruding blocks of the driven cam in the second state; wherein the impact block only can do a single-directional movement when the clamping member is located between any two protruding blocks of the driven cam in the first state.

In the present invention, during the process of retracting the impact block (e.g., a firing pin), the clamping member is utilized to contact or engage with the ratchet wheel (or the driven cam) such that the impact block only can move along the retracting direction. Accordingly, the process of retracting the impact block is increased in stability. Further, the power transmission assembly of the electric motor only can make the gearwheel and the ratchet wheel do a single-directional motion. This further improves the stability of impact block retracting. Therefore, the entire process of retracting the impact block is quite stable in the present invention, and therefore the effect on impact block launching, caused by unable to make the impact block move back to the start position, can be reduced.

DETAILED DESCRIPTION OF THE INVENTION

Figure 1:
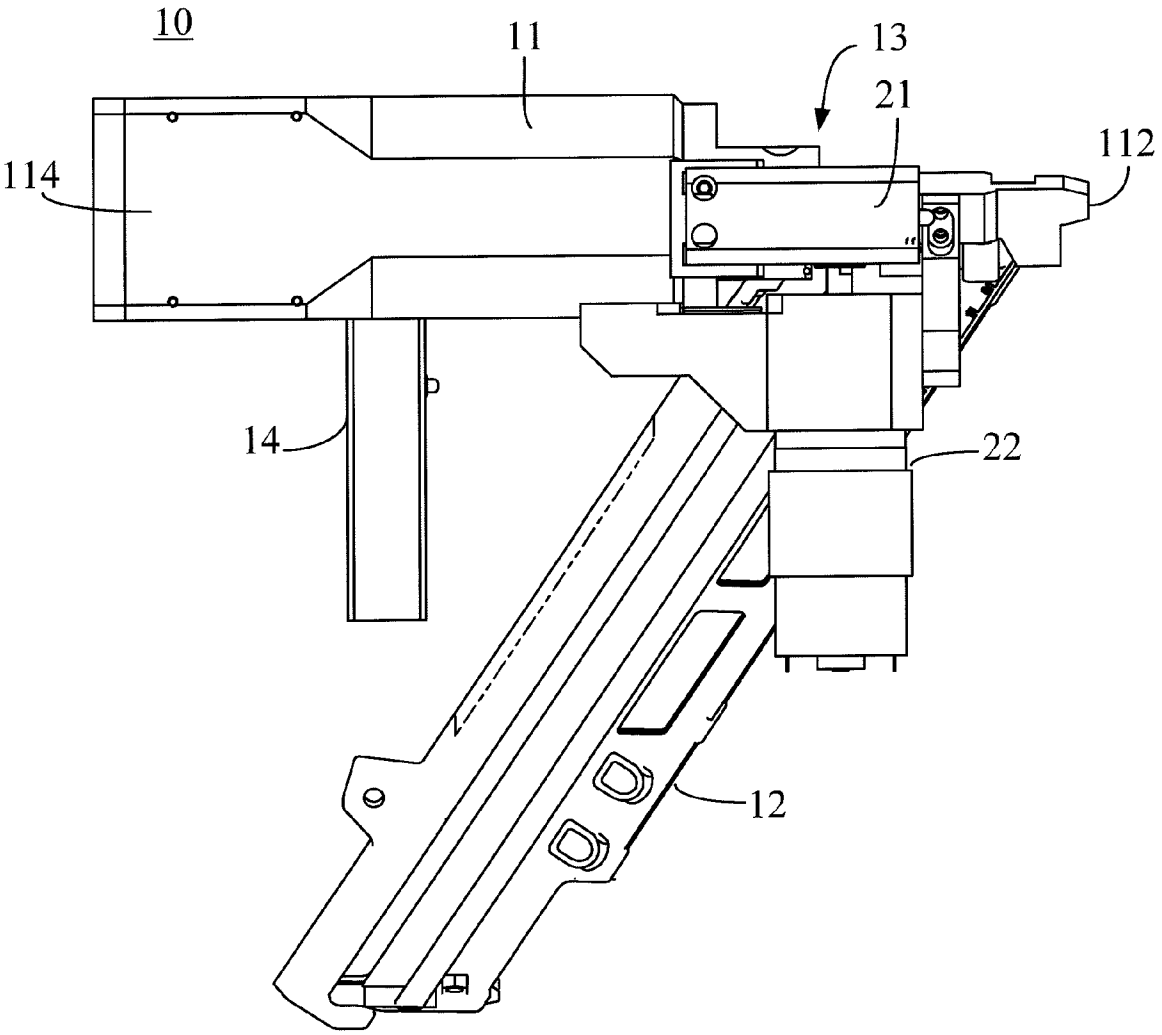
FIG. 1 is a schematic diagram showing a handheld power tool in accordance with the present invention.

FIG. 1 is a schematic diagram showing a handheld power tool 10 in accordance with the present invention. For the handheld power tool 10 (e.g., a power actuated nail gun) shown in FIG. 1, only the parts carrying out the technical effects of the present invention are shown, instead of all parts of a manufactured product. It should be understood that the handheld power tool 10 shown in FIG. 1 is merely for illustrating the present invention.

As shown in FIG. 1, the handheld power tool 10 comprises a main body 11, a nail magazine 12, an impact block return device 13, and a start switch 14. The main body 11 has an exit 112 at one end thereof, which communicates with the nail magazine 12 and the impact block return device 13. The main body 11 has a compressed air chamber 114 at the other end thereof, which accommodates an impact block 15 (see FIG. 2A). The impact block return device 13 is disposed between the compressed air chamber 114 and the exit 112. Nails (or called fasteners) (not shown) are placed into the nail magazine 12. The nail magazine 12 communicates with the exit 112. When impacted by the impact block 15, a nail released from the nail magazine 12 is discharged from the handheld power tool 10 and is driven into a workpiece (not shown) from the exit 112 to the surface of the workpiece. The compressed air chamber 114 is an air spring chamber used to store energy for supplying power to the impact block 15. The start switch 14 is packaged and arranged on a holding part of the machine tool for ON/OFF switching in regards to nail shooting operations made by a user. In one embodiment, as illustrated in FIG. 1, the compressed air chamber 114 aggregates or stores energy and air spring energy serves as the power source of the impact block 15. In another embodiment, other approaches may be adopted for power conversion, for example, a flywheel power transmission system may be used.

Figure 2A:
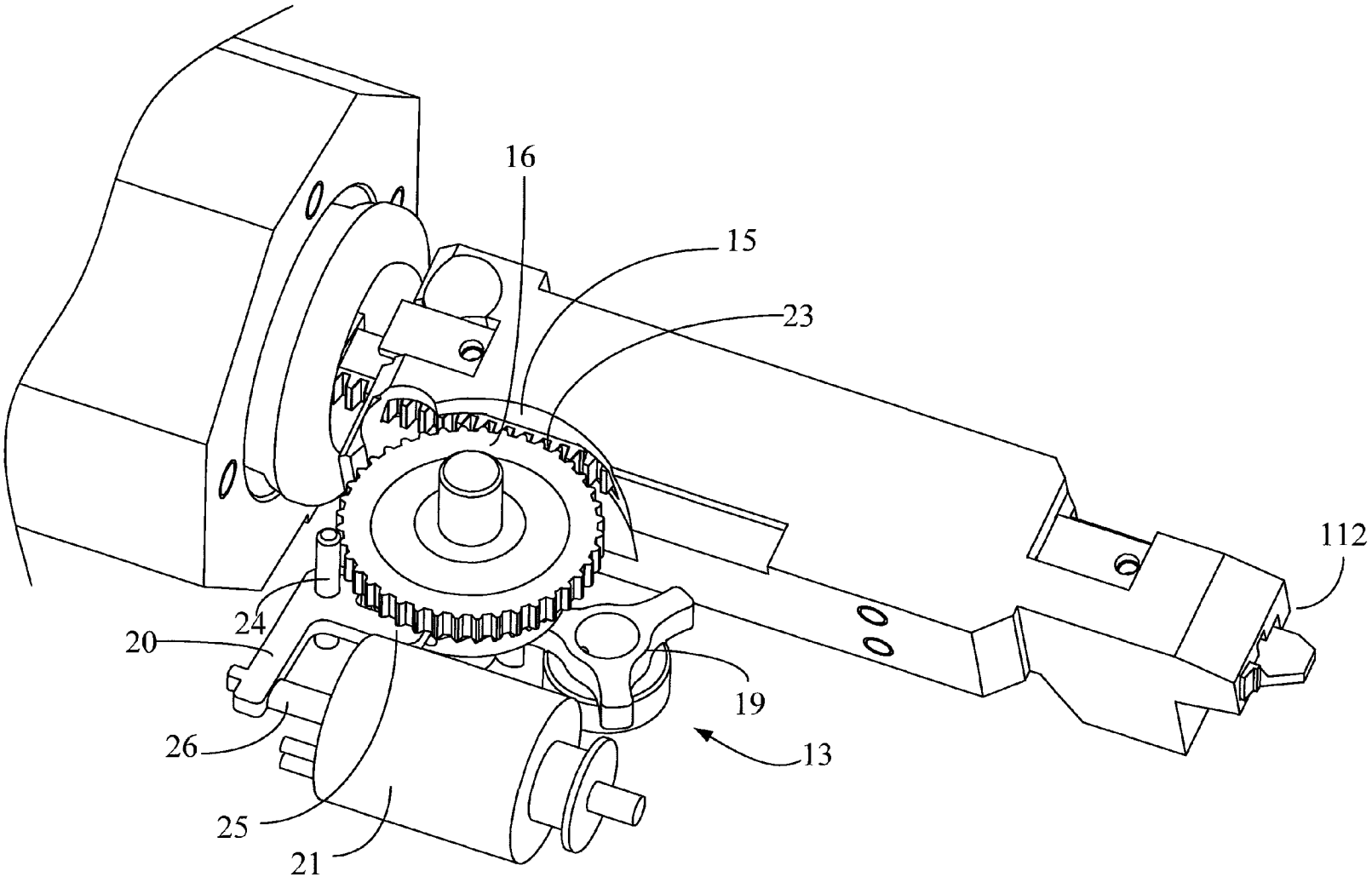
FIG. 2A is a perspective view of a partial enlargement of the handheld power tool shown in FIG. 1.
Figure 2B:
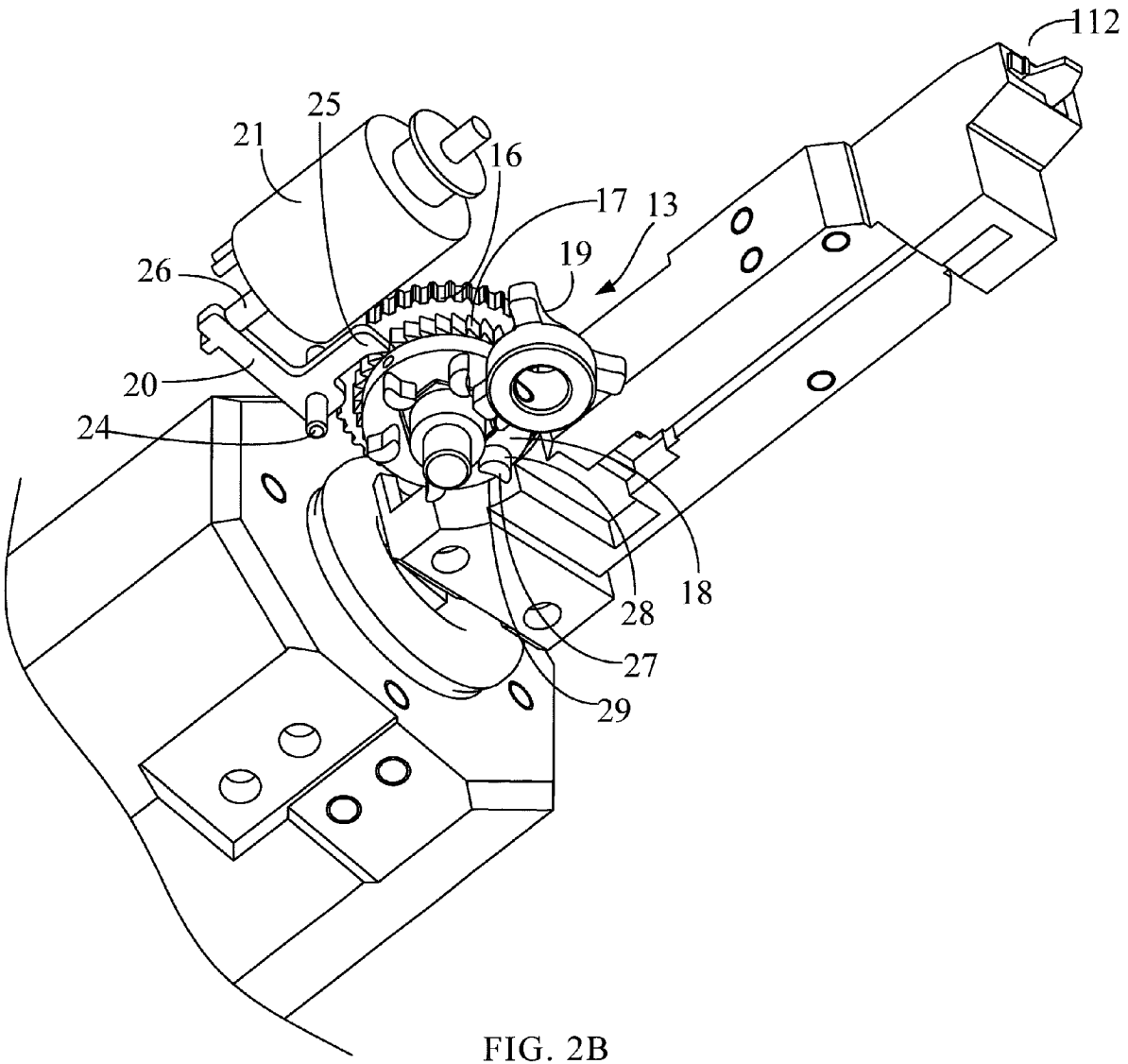
FIG. 2B is another perspective view of the partial enlargement of the handheld power tool shown in FIG. 1.

FIG. 2A is a perspective view of a partial enlargement of the handheld power tool 10 shown in FIG. 1. FIG. 2B is another perspective view of the partial enlargement of the handheld power tool 10 shown in FIG. 1. Some components such as an external cover and a packaging structure are omitted in FIG. 2A and FIG. 2B for clearly showing internal structure of the handheld power tool 10.

As shown in FIG. 1, FIG. 2A, and FIG. 2B, the impact block return device 13 comprises a gearwheel 16, a ratchet wheel 17, a power transmission assembly (including a driven cam 18 and an actuating cam 19), a clamping member 20, an electric motor 22, and an electromagnetic component 21 used to control the motion of the clamping member 20. The electric motor 22 is not shown in FIG. 2A and FIG. 2B. However, the actuating cam 19 is in fact connected to a rotating shaft of the electric motor 22 (see FIG. 1) and the actuating cam 19 rotates as it is driven by the electric motor 22.

The impact block 15 moves along a straight line as it is actuated by the power source (e.g., the energy stored in the air spring chamber 114), and passes the dynamic energy to the nail such that the nail is discharged from the exit 112. The impact block 15 has a plurality of continuous teeth 23 arranged along a lengthwise direction of the impact block 15. The teeth 23 are preferably disposed on only one side edge of the impact block 15 such that the overall thickness of the impact block 15 is even. The teeth 23 of the impact block 15 is adjacent to the gearwheel 16 and they mesh with each other. Accordingly, the rotation of the gearwheel 16 will put the impact block 15 in a linear motion. The movement of the impact block 15 actuated by the power source can also drive the gearwheel 16 to rotate. The number of the teeth 23 of the impact block 15 is not particularly restricted as long as they can cooperate with the gearwheel 16 stably.

The gearwheel 16, the ratchet wheel 17, and the driven cam 18 are linked and these three pieces can rotate simultaneously. In one preferable embodiment, the gearwheel 16, the ratchet wheel 17, and the driven cam 18 have a same rotating shaft. That is, these three components rotate along the same rotating shaft. Such an arrangement may simplify the complexity of transmission mechanism.

The clamping member 20 is disposed at a position corresponding to the ratchet wheel 17 and is located far away from the teeth 23 of the impact block 15. The clamping member 20 is operable in a first state and a second state. When the clamping member 20 is operated in the first state, the clamping member 20 contacts or is engaged with the ratchet wheel 17 such that the ratchet wheel 17 only can do a single-directional rotation, thereby restricting the rotation directions of the gearwheel 16 and the driven cam 18. When the clamping member 20 is operated in the second state, the clamping member 20 is separated from the ratchet wheel 17 and meanwhile, the gearwheel 16, the ratchet wheel 17, and the driven cam 18 can simultaneously rotate clockwise or counterclockwise.

For example, as shown in FIG. 2A and FIG. 2B, the clamping member 20 can be implemented by an L-shaped member with its bending part connecting to a shaft rod 24, which is movably embedded into a fastening member (not shown). The L-shaped member 20 has a protrusion part 25 at a first terminal thereof. The protrusion part 25 is used to engage with teeth on the ratchet wheel 17. A second terminal of the L-shaped member 20 contacts a rod 26, which is connected to the electromagnetic component 21. After magnetized, the electromagnetic component 21 can push the rod 26 such that the rod 26 stretches out, and further the rod 26 pushes the second terminal of the L-shaped member 20, making the L-shaped member 20 rotate along the axis of the shaft rod 24. In such a manner, the protrusion part 25 at the first terminal of the L-shaped member 20 is separated from the ratchet wheel 17 (i.e., the second state). After demagnetized, the electromagnetic component 21 draws the rod 26 inward. The L-shaped member 20 is actuated by a spring (not shown) such that the protrusion part 25 at the first terminal of the L-shaped member 20 is located at a position where the protrusion part 25 engages with the ratchet wheel 17 (i.e., the first state).

During the process of shooting the nail, that is, during the impact block 15 is actuated by the power source and thus moves from a start position to a stop position, the electromagnetic component 21 is magnetized such that the protrusion part 25 of the first terminal of the clamping member 20 is at the second state separating from the ratchet wheel 17. In such a manner, even though the impact block 15 leads the gearwheel 16 to rotate during the process of shooting the nail, the gearwheel 16 will not be affected by the clamping member 20, causing a dramatic decrease in dynamic energy.

Further, during the process of retracting the impact block 15, that is, during the impact block 15 moves from the stop position back to the start position, the electromagnetic component 21 is demagnetized such that the protrusion part 25 of the first terminal of the clamping member 20 is at the first state contacting or engaging with the ratchet wheel 17. Meanwhile, the impact block 15 only can do a single-directional movement (its direction is identical to the direction retracting the impact block 15). Therefore, the process of retracting the impact block 15 is more stable.

In addition, the power transmission assembly (including the actuating cam 19 and the driven cam 18) only can make the gearwheel 16 and the ratchet wheel 17 do a unidirectional rotation. As shown in FIG. 2A and FIG. 2B, a wheel face of the driven cam 18 is overlapped with the surface of the ratchet wheel 17, and the other wheel face of the driven cam 18 has a plurality of protruding blocks 27 disposed thereon. The protruding blocks 27 are annularly arranged at intervals. Preferably, these protruding blocks 27 are semicircular protruding blocks, and the side opposite to the circular edge 28 of each semicircular protruding block is a concave surface 29. Only when the actuating cam 19 rotates along one particular direction, the circular edges 28 are able to be pushed so as to make the driven cam 18 rotate.

In a preferred embodiment of the present invention, the electric motor 22 can be implemented by a motor electronically controlled, in which the rotating direction of the axis is controlled, and further the number of rotations can also be controlled such that it rotates in accordance with a predetermined number of rotations.

Referring to FIG. 2B, during the process of retracting the impact block 15, the electric motor 22 rotates along a same direction (e.g., a clockwise motion viewing from top to bottom) in accordance with a predetermined number of rotations. The rotation of the electric motor 22 leads to a clockwise rotation of the actuating cam 19, and through the power transmission between the actuating cam 19 and the driven cam 18, the gearwheel 16 and the ratchet wheel 17 will rotate counterclockwise (viewing from to top to bottom). The engagement of the gearwheel 16 and the teeth 23 of the impact block 15 further lead the impact block 15 to move along the retracting direction. The predetermined number of rotations of the electric motor 22 matches the distance between the stop position and the start position of the impact block. In such a manner, the impact block 15 is happened to be retracted to the star position when the electric motor 22 rotates in accordance with the predetermined number of rotations.

In addition, before the impact block 15 is prepared to be launched and thus make the gearwheel 16, the ratchet wheel 17, and the driven cam 18 rotate, the actuating cam 19 can be controlled by the electric motor 22 so as to maintain at a hovering state without contacting the driven cam 18. In such a manner, the load in launching the impact block 15 is lowered and a relatively large power is preserved.

In addition, the electric motor 22 is preferably a motor capable of generating a greater torque; otherwise, a common motor may be used in cooperation with a speed reducing mechanism to generate a larger torque.

FIGS. 3A to 3E are diagrams illustrating the respective operations of the afore-mentioned mechanism. The following descriptions will illustrate the entire shooting and retracting process of the impact block 15 in accompanying with FIGS. 3A to 3E.

Figure 3A:
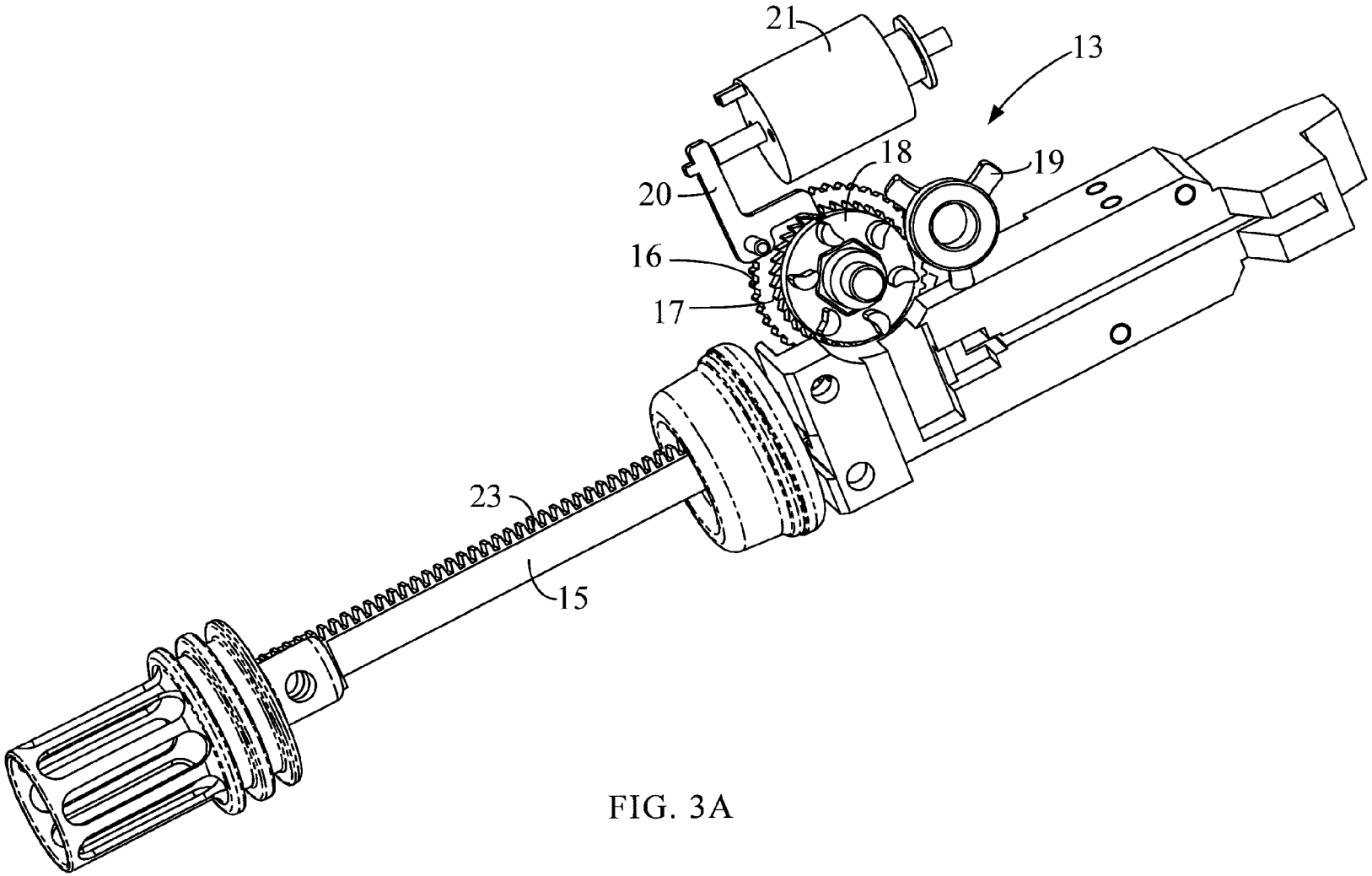
FIG. 3A is a schematic diagram showing an impact block in a to-be-shoot state.

(1) To-be-shoot state. As shown in FIG. 3A, the impact block 15 is located at the start position. The electromagnetic component 21 is demagnetized or not magnetized such that the clamping member 20 contacts or is engaged with the ratchet wheel 17. This can avoid unexpected motions occurred on the impact block 15. In this state, the actuating cam 19 stops rotating and is stopped at a hovering state without contacting the driven cam 18.

Figure 3B:
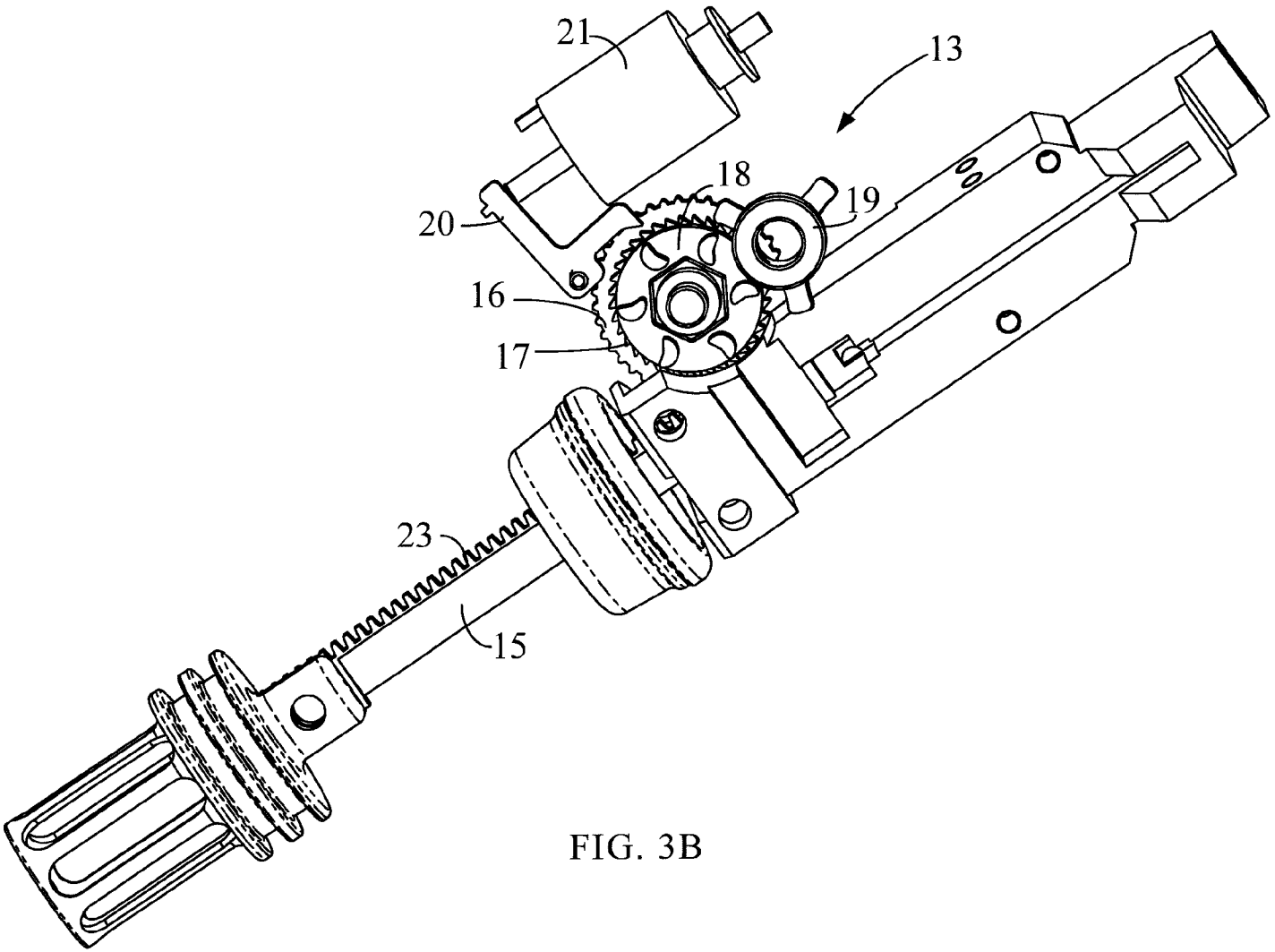
FIG. 3B is a schematic diagram showing an impact block in a shooting state.

(2) Shooting state. As shown in FIG. 3B, the impact block 15 moves from the start position to the stop position. In this process, the electromagnetic component 21 is in a magnetized state such that the clamping member 20 is separated from the ratchet wheel 17. In such a manner, the dynamic energy of the impact block 15 is not affected by the clamping member 20. The electric motor 22 is not activated. The teeth 23 of the impact block 15 lead to the rotation of the gearwheel 16.

Figure 3C:
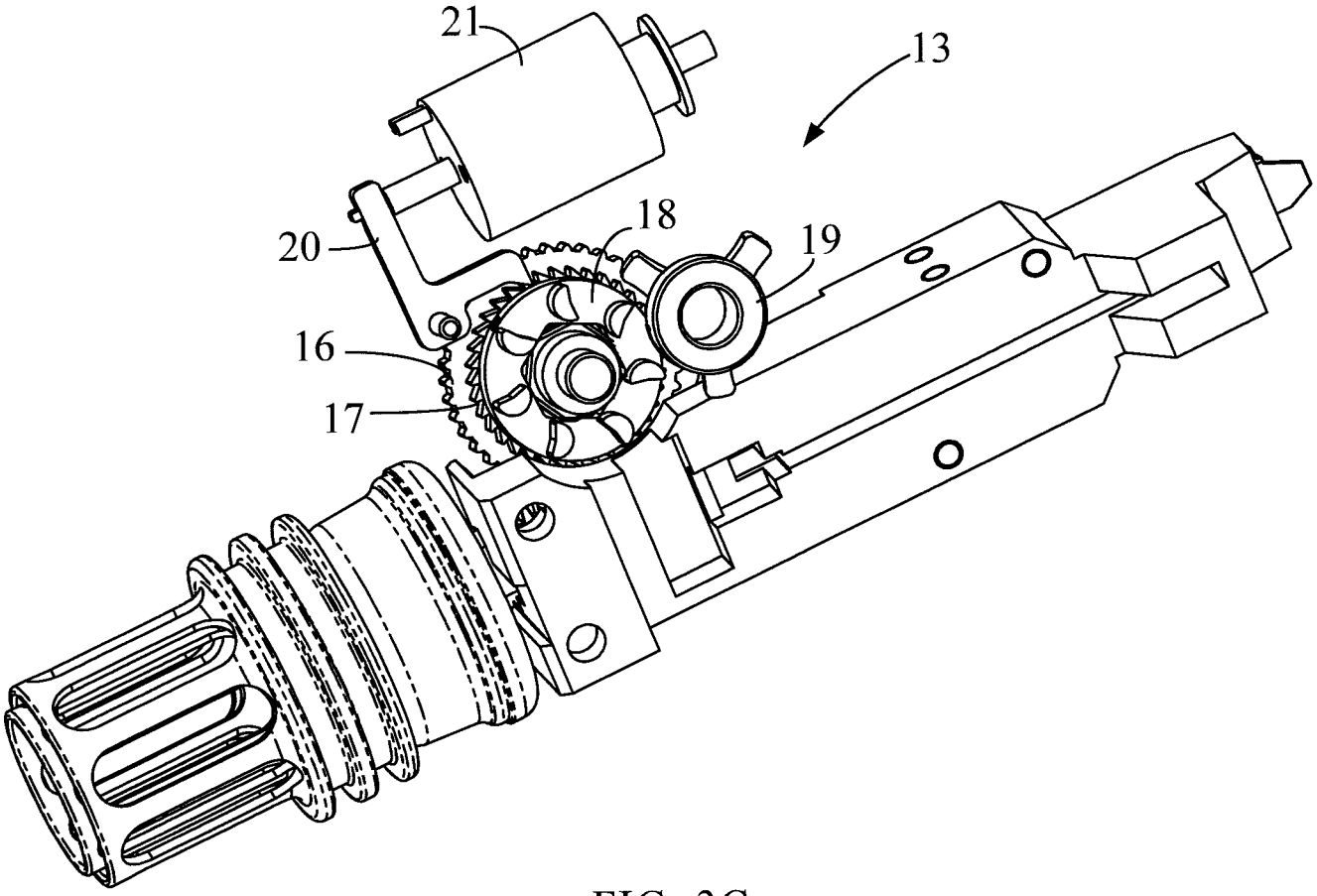
FIG. 3C is a schematic diagram showing an impact block in a completion state of shooting.

(3) Completion state of shooting. As shown in FIG. 3C, the impact block 15 is located at the stop position. Meanwhile, the electromagnetic component 21 is demagnetized such that the clamping member 20 contacts or is engaged with the ratchet wheel 17. This can prevent the ratchet wheel 17 from unexpected rotations. On the other hand, it is convenient for the impact block 15 to go to the retracting process.

Figure 3D:
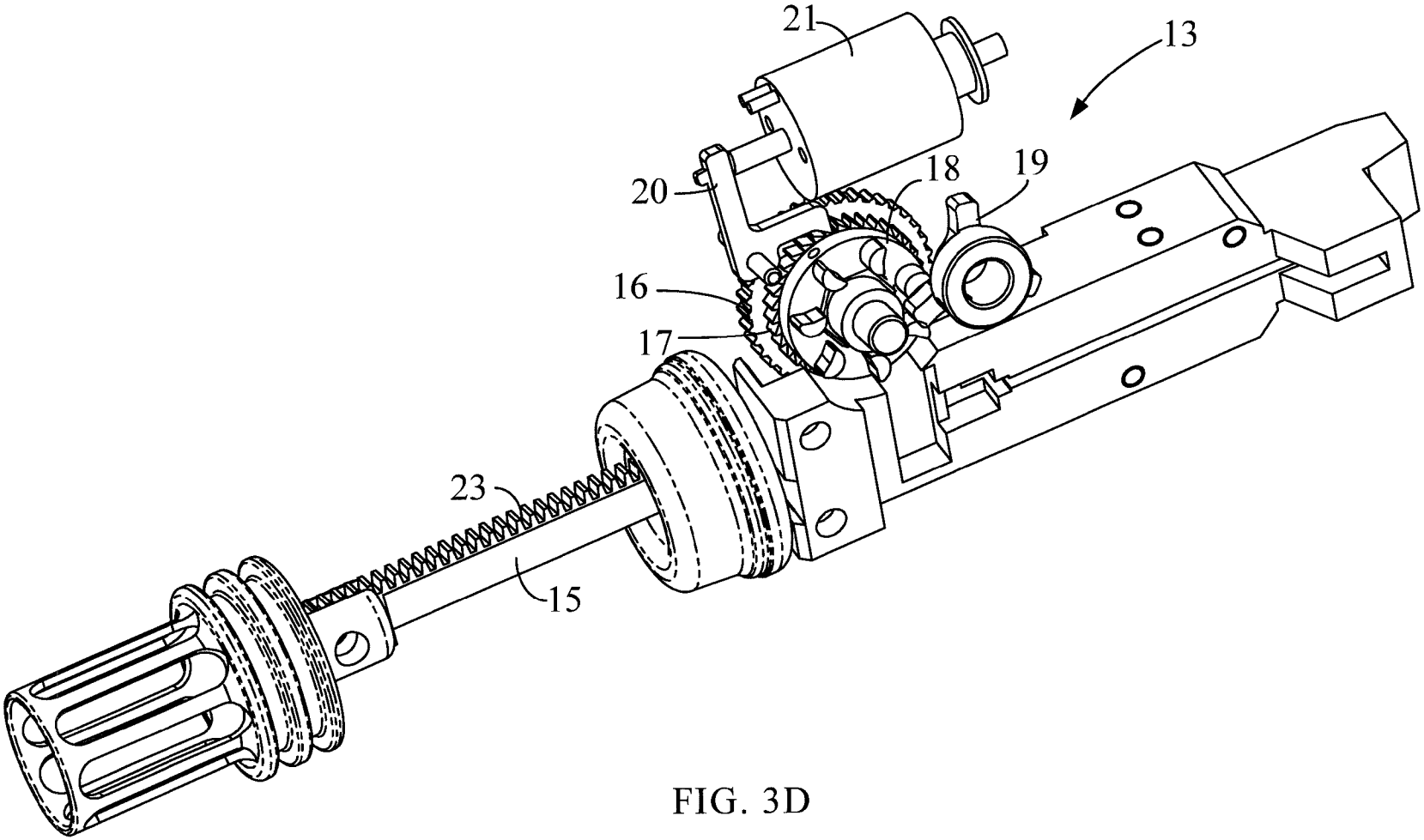
FIG. 3D is a schematic diagram showing an impact block in a retracting state.

(4) Retracting state. As shown in FIG. 3D, the impact block 15 moves from the stop position to the start position. In this process, the clamping member 20 is at a state contacting or being engaged with the ratchet wheel 17 for assuring that the impact block 15 only can move along the retracting direction in the process of retracting the impact block 15, thereby making the whole retracting process more stable. In this retracting stage, the electric motor 22 is activated, the actuating cam 19 drives the driven cam 18, and thus the gearwheel 16 rotates. The rotation of the gearwheel 16 leads the impact block 15 to move back to the start position.

Figure 3E:
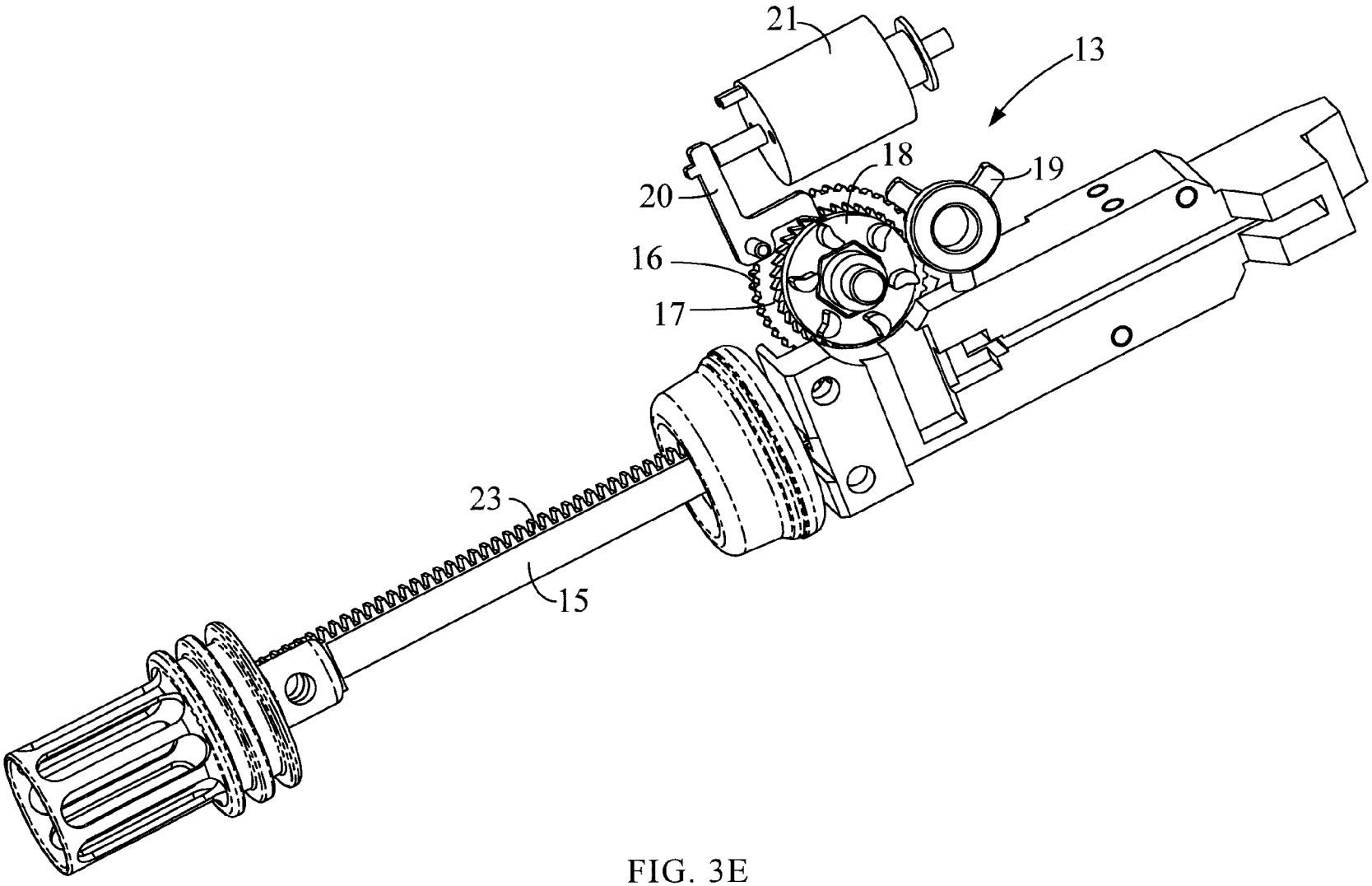
FIG. 3E is a schematic diagram showing an impact block in a completion state of retracting.

(5) Completion state of retracting. As shown in FIG. 3E, the impact block 15 is back to the start position. The electric motor 22 stops rotating. Meanwhile, the clamping member 20 still contacts or engages with the ratchet wheel 17. This assures that the impact block 15 will not deviate from the start position due to unexpected motions. Therefore, the impact block 15 may not have insufficient shooting energy due to position deviation in next shooting.

Figure 4A:
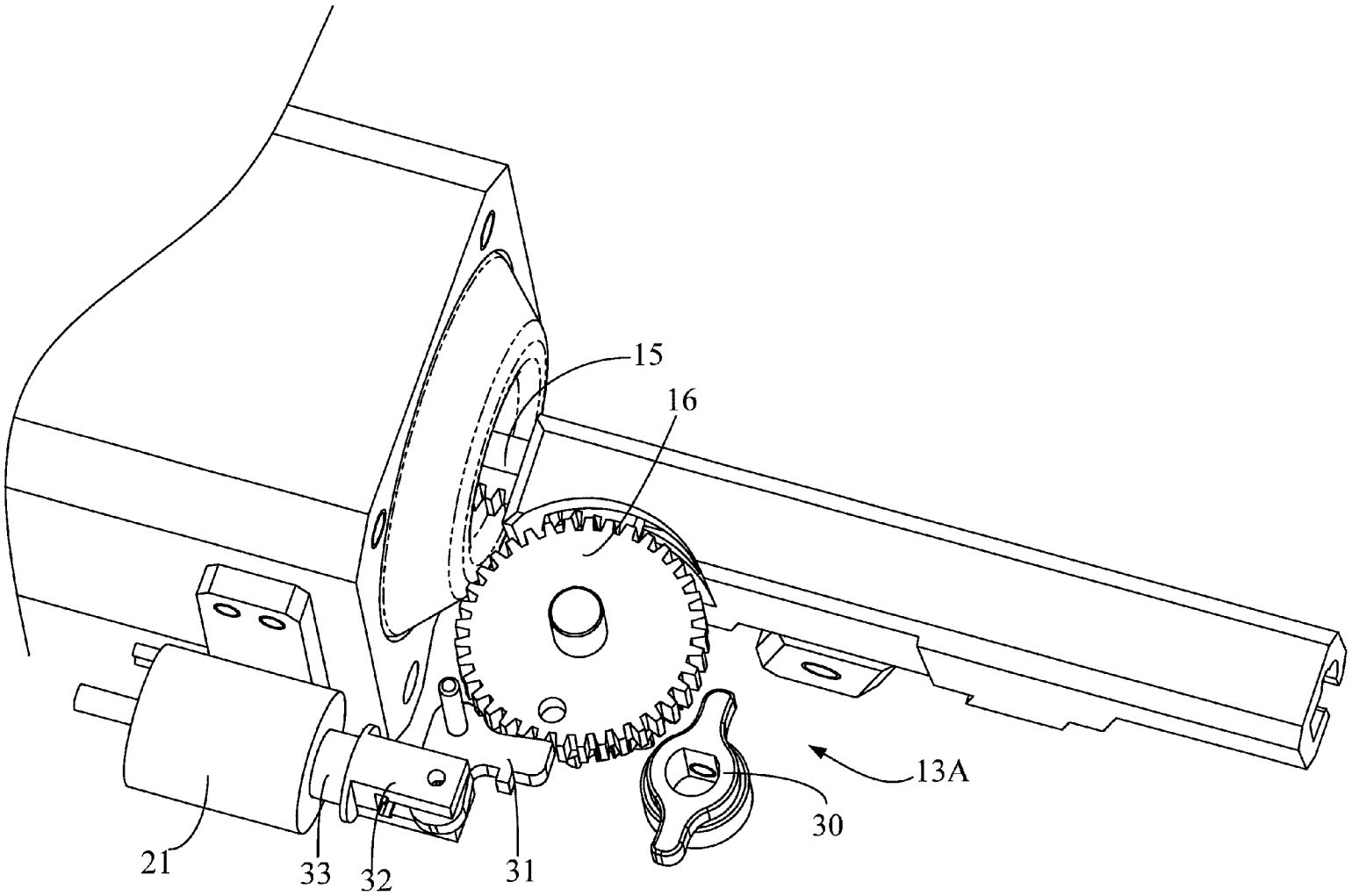
FIG. 4A is a perspective view of an impact block return device in accordance with an embodiment of the present invention.
Figure 4B:
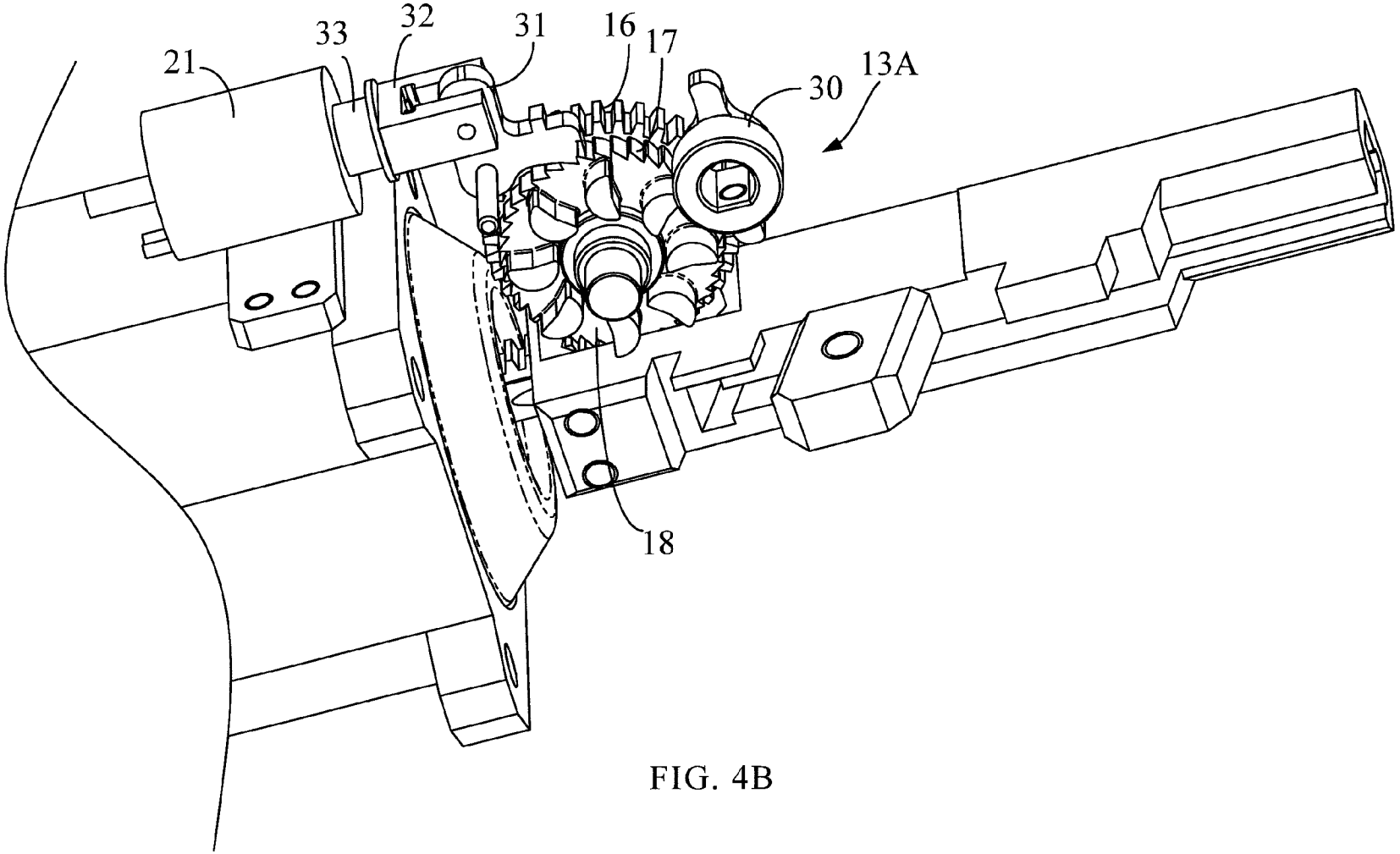
FIG. 4B is another perspective view of the impact block return device in accordance with the embodiment of the present invention.

FIG. 4A and FIG. 4B are schematic diagrams showing an impact block return device in accordance with an embodiment of the present invention. The difference between this embodiment and the embodiment of the impact block return device 13 illustrated in FIG. 2A and FIG. 2B is that in the impact block return device 13A shown in FIG. 4A and FIG. 2B, the teeth of the actuating cam 30 have two teeth and this indicates that the number of teeth of the actuating cam 30 can be adjusted according to demand. In addition, one end of the clamping member 31 is fixed to of a U-shaped member 32 at the opening thereof. The U-shaped member 32 is connected to a rod 33 at the bottom thereof. When the rod 33 extends out or draws back due to the action of the electromagnetic component 21, it can lead the clamping member 31 to be in two states (i.e., the contact state and the separation state).

Figure 5A:
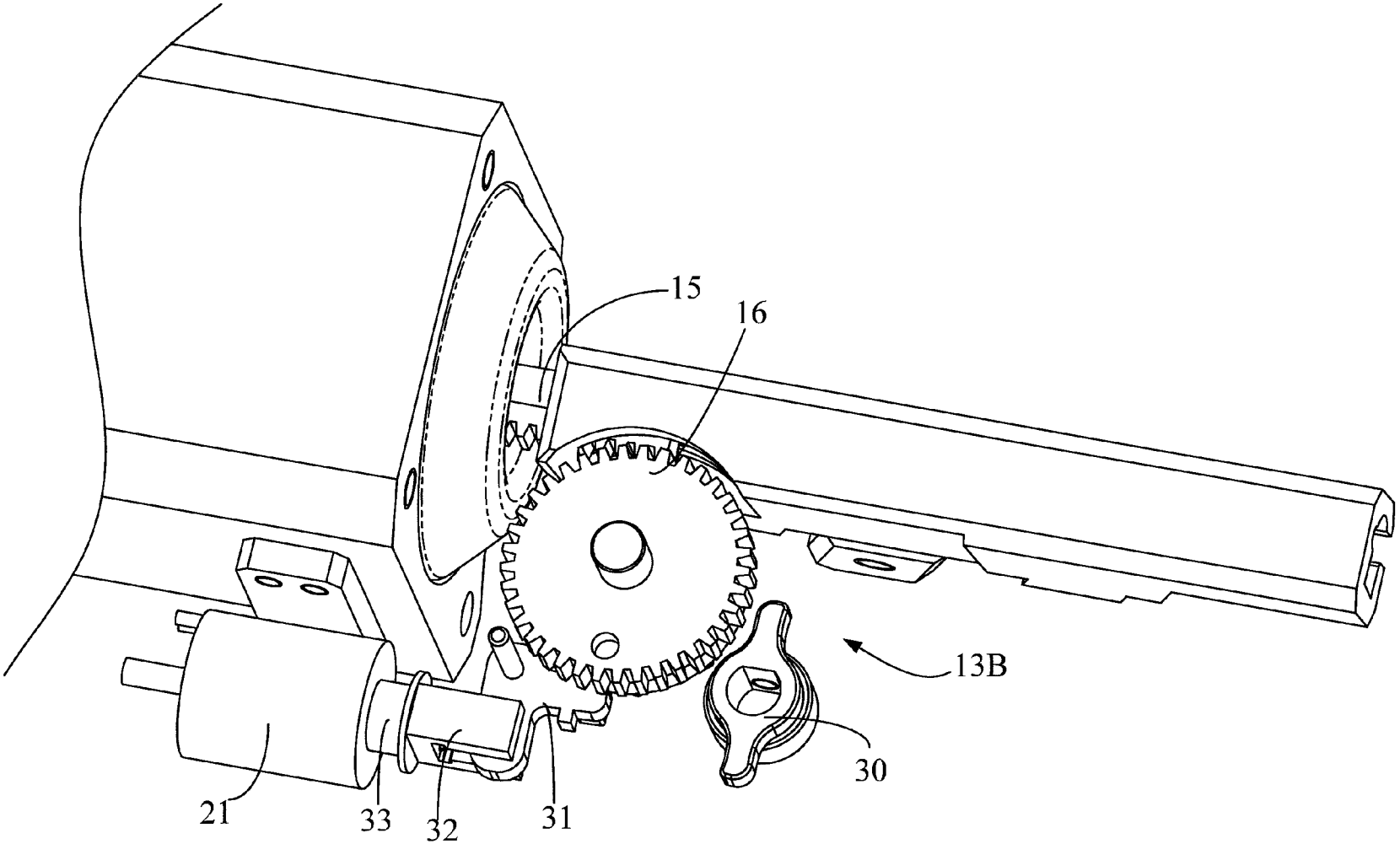
FIG. 5A is a perspective view of an impact block return device in accordance with another embodiment of the present invention.
Figure 5B:
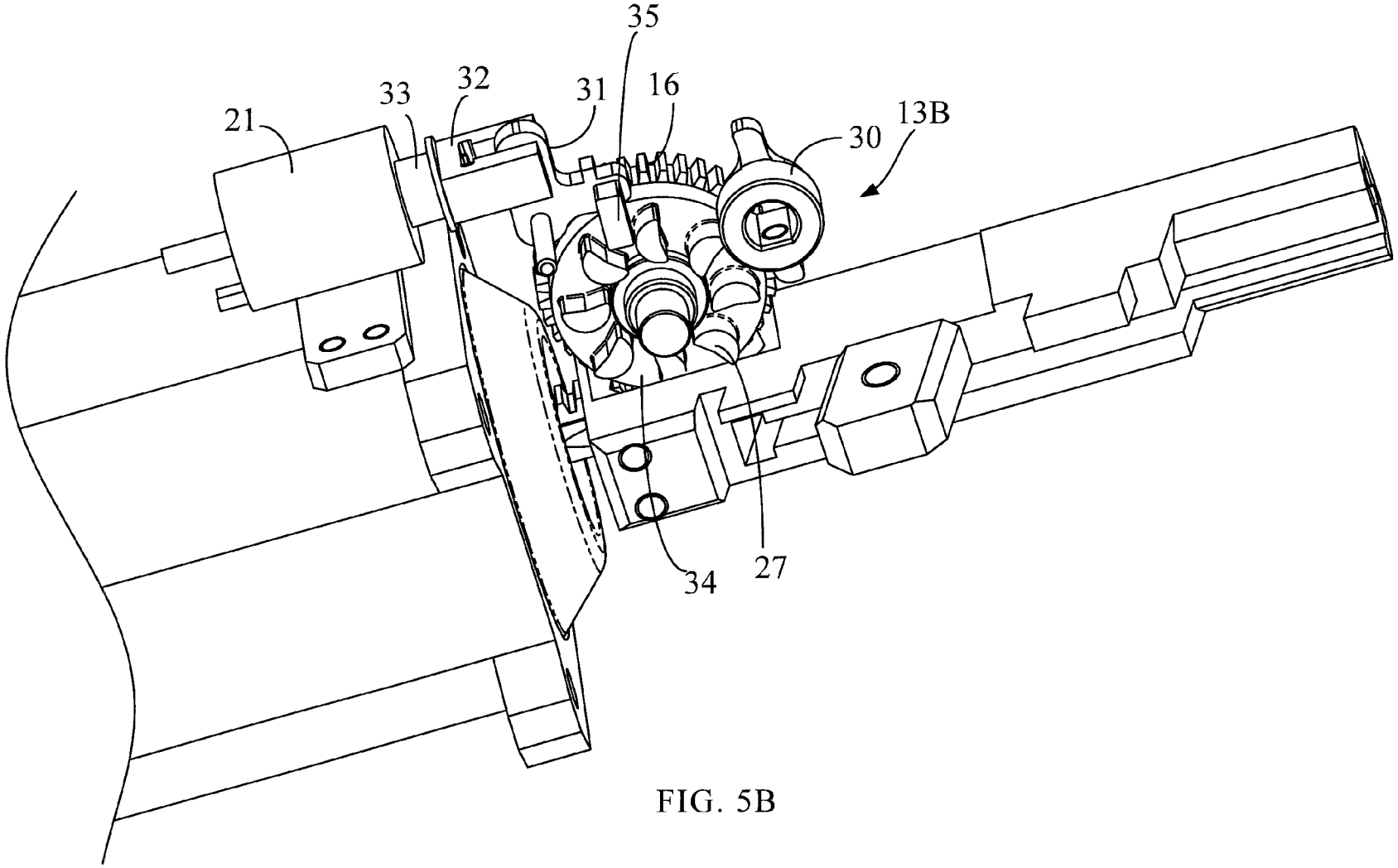
FIG. 5B is another perspective view of the impact block return device in accordance with said another embodiment of the present invention.

FIG. 5A and FIG. 5B are schematic diagrams showing an impact block return device in accordance with another embodiment of the present invention. The difference between this embodiment and the embodiment of the impact block return device 13A illustrated in FIG. 4A and FIG. 4B is that in the impact block return device 13B shown in FIG.

5A and FIG. 5B, the ratchet wheel is removed and the driven cam 34 is utilized to replace the ratchet wheel in the original arrangement. The driven cam 34 and the gearwheel 16 have a same rotation axis. The protrusion part 35 of the clamping member 31 can be engaged with the protruding blocks 27 of the driven cam 34. In such a manner, the motion of the gearwheel 16 can be restricted to a single-directional rotation. The principles and operational processes in this embodiment is the same as above descriptions.

In the present invention, during the retraction process of the impact block (e.g., a firing pin), the clamping member is utilized to contact or engage with the ratchet wheel (or the driven cam) such that the impact block only can move along the retracting direction. Accordingly, the retraction process of the impact block is increased in stability. Further, the power transmission assembly of the electric motor only can make the gearwheel and the ratchet wheel do a single-directional motion. This further improves the stability of impact block retracting. Therefore, the entire process of retracting the impact block is quite stable in the present invention, and therefore the effect on impact block launching, caused by unable to make the impact block move back to the start position, can be reduced.

While the preferred embodiments of the present invention have been illustrated and described in detail, various modifications and alterations can be made by persons skilled in this art. The embodiment of the present invention is therefore described in an illustrative but not restrictive sense. It is intended that the present invention should not be limited to the particular forms as illustrated, and that all modifications and alterations which maintain the spirit and realm of the present invention are within the scope as defined in the appended claims.

What is claimed is:

1. A handheld power tool, having a main body, a nail magazine, an impact block, and an impact block return device, the main body having an exit at one end thereof, the exit communicating with the nail magazine and the impact block return device, the main body having a compressed air chamber at the other end thereof, the compressed air chamber accommodating the impact block, the impact block having a plurality of continuous teeth arranged along a lengthwise direction of the impact block, the impact block return device comprising:

a gearwheel adjacent to and engaged with the teeth of the impact block;

a ratchet wheel connecting to the gearwheel and rotating simultaneously with the gearwheel; and a clamping member disposed at a position corresponding to the ratchet wheel and located away from the teeth of the impact block, the clamping member being operated in a first state and a second state, the clamping member contacting the ratchet wheel in the first state and the clamping member being separated from the ratchet wheel in the second state;

wherein the impact block only can do a single-directional movement when the clamping member contacts the ratchet wheel in the first state.

2. The handheld power tool according to claim 1, wherein the impact block return device further comprises:

a power transmission assembly for driving the gearwheel and the ratchet wheel to rotate, wherein the power transmission assembly only can make the gearwheel and the ratchet wheel do a unidirectional rotation.

3. The handheld power tool according to claim 2, wherein the power transmission assembly comprises:

a driven cam rotating simultaneously with the gearwheel and the ratchet wheel; and an actuating cam driven by an electric motor, wherein the actuating cam drives the driven cam only when the actuating cam rotates along a particular direction.

4. The handheld power tool according to claim 3, wherein the gearwheel, the ratchet wheel, and the driven cam have a same rotation axis.

5. The handheld power tool according to claim 1, wherein the impact block return device further comprises:

an electromagnetic component for controlling the clamping member such that the clamping member changes between the first state and the second state.

6. The handheld power tool according to claim 1, wherein during the impact block is actuated by a power source and thus moves from a start position to a stop position, the clamping member is at the second state separating from the ratchet wheel.

7. The handheld power tool according to claim 1, wherein during the impact block moves from a stop position back to a start position, the clamping member is at the first state contacting the ratchet wheel.

8. An impact block return device for retracting an impact block having a plurality of continuous teeth arranged along a lengthwise direction of the impact block, the impact block return device comprising:

a gearwheel engaged with the teeth of the impact block;

a driven cam coupled to the gearwheel and rotating simultaneously with the gearwheel, the driven cam having a plurality of protruding blocks disposed on a wheel face thereof, the protruding blocks being annularly arranged at intervals;

an actuating cam driven by an electric motor, for driving the driven cam; and a clamping member disposed at a position corresponding to the driven cam and located away from the teeth of the impact block, the clamping member being operated in a first state and a second state, the clamping member being located between any two protruding blocks of the driven cam in the first state and the clamping member being moved away from a moving track of the protruding blocks of the driven cam in the second state;

wherein the impact block only can do a single-directional movement when the clamping member is located between any two protruding blocks of the driven cam in the first state.

9. The impact block return device according to claim 8, wherein the actuating cam drives the driven cam only when the actuating cam rotates along a particular direction.

10. The impact block return device according to claim 8, wherein the gearwheel and the driven cam have a same rotation axis.

* * * * *